United States Patent [19]

Awano et al.

[11] Patent Number: 4,928,882

[45] Date of Patent: May 29, 1990

[54] COATING GUN

[75] Inventors: Hikaru Awano, Owariasahi; Seiichi Asai, Seto; Katsuo Kaneko, Kashiwa; Hiroshi Kaida, Nagareyama; Fujio Yoshida, Hiroshima, all of Japan

[73] Assignee: Cashew Company, Ltd., Saitama, Japan

[21] Appl. No.: 326,034

[22] Filed: Mar. 20, 1989

[30] Foreign Application Priority Data

Mar. 29, 1988 [JP] Japan ..... 63-75107

[51] Int. Cl.[5] ..... B05B 15/02

[52] U.S. Cl. ..... 239/112

[58] Field of Search ..... 239/112

[56] References Cited

U.S. PATENT DOCUMENTS 3,945,569 3/1976 Speary ..... 239/112

4,745,011 5/1988 Fukuta et al. ..... 239/112 X

*Primary Examiner*—Andres Kashnikow

*Assistant Examiner*—William Grant

*Attorney, Agent, or Firm*—Wenderoth, Lind & Ponack

[57] ABSTRACT

A coating gun wherein a quick-drying paint or bonding agent is prevented from leaking out of the gun body during a coating operation and solidifying on the gun body, so that smooth operation of the valve rod controlling discharge of the coating material is obtained. The coating gun has a feed path in the gun body provided with an on-off valve and communicates at the forward end portion thereof with a nozzle at the forward end of the gun body. A guide hole is provided between the feed path and the rear surface of the gun body and a valve rod forming a valve body of the on-off valve is closedly fitted in and slidably extended through the guide hole. The rear end portion of the valve rod is connected to a driving mechanism for opening or closing the on-off valve and which is mounted on the rear surface of the gun body. The inner periphery of the sliding guide hole has a cleaning chamber surrounding the outer periphery of the valve rod, and the gun body has therein a feed port for feeding a solvent to the cleaning chamber and a discharge port for discharging the solvent from the cleaning chamber.

1 Claim, 2 Drawing Sheets

COATING GUN

BACKGROUND OF THE INVENTION

1. Field of the Invention

The present invention relates to a coating gun wherein a quick-drying paint or bonding agent being discharged therefrom is prevented from leaking out of the gun body and solidifying during a coating operation so that a valve rod will operate smoothly.

2. Description of the Prior Art

A coating gun has heretofore been constructed such that a feed path in the gun body is provided therein with an on-off valve and communicated at the forward end portion thereof with a nozzle at the forward end of the gun body. A guide hole is provided for communicating the feed path and the rear surface of the gun body with each other. A valve rod connected to a valve body of the on-off valve is closely fitted in and slidably extended through the guide hole, and the rear end portion of the valve rod is connected to a driving mechanism for opening or closing the on-off valve, such as an air cylinder or a trigger, which are mounted on the gun body. The valve rod is caused to slide in the guide hole by the driving mechanism to open or close the valve, so that a paint or a bonding agent can be discharged from the nozzle or shut off. In consequence, it is unavoidable that the paint or the bonding agent in the feed path leaks into a gap formed between the sliding valve rod and the guide hole, is conveyed along the outer periphery of the valve rod, and leaks out to the rear surface of the gun body. In the past, when a quick-drying paint or bonding agent such as an emulsion paint has been discharged through the gun, there has been the disadvantage that, during the coating operation, the leaking paint or bonding agent was brought into contact with air, whereby the paint or bonding agent was solidified on the outer peripheral surface of the valve rod between the rear surface of the gun body and the driving mechanism, and the thus solidified paint or bonding agent engaged the rear surface of the gun body or the driving mechanism, so that the valve rod was prevented from operating smoothly.

SUMMARY OF THE INVENTION

As a means for solving the above-described problems, the present invention has a construction in which a feed path in the gun body is provided therein with an on-off valve and communicated at the forward end portion thereof with a nozzle at the forward end of the gun body. A guide hole is provided for communicating the feed path and the rear surface of the gun body with each other. A valve rod connected to a valve body of the on-off valve is closely fitted in and slidably extended through the guide hole, and the rear end portion of the valve rod is connected to a driving mechanism for opening or closing the on-off valve and which is mounted on the rear surface of the gun body. The inner periphery of the guide hole is provided with an expanded diameter portion which forms a cleaning chamber surrounding the outer periphery of the valve rod, and the gun body is provided with a feed port for feeding a solvent to the cleaning chamber and a discharge port for discharging the solvent from the cleaning chamber.

In the operation of the above-described arrangement, the solvent is continuously fed into the cleaning chamber through the feed port and continuously discharged through the discharge port during the coating operation, whereby the paint or bonding agent, which has leaked from the feed path along the outer periphery of the valve rod and has leaked into the guide hole, is dissolved in the solvent in the cleaning chamber and discharged together with the solvent through the discharge hole, whereby the paint or bonding agent and the solvent are not conveyed along the outer periphery of the valve rod and do not leak out to the rear surface of the gun body through the guide hole, so that there is no paint or bonding agent which has leaked out and solidified to engage the rear surface of the gun body or the driving mechanism, thereby achieving the advantage of maintaining smooth sliding of the valve rod.

BRIEF DESCRIPTION OF THE DRAWINGS

The accompanying drawings show one embodiment of the present invention, wherein.

DETAILED DESCRIPTION OF THE PREFERRED EMBODIMENTS

Figure 1:
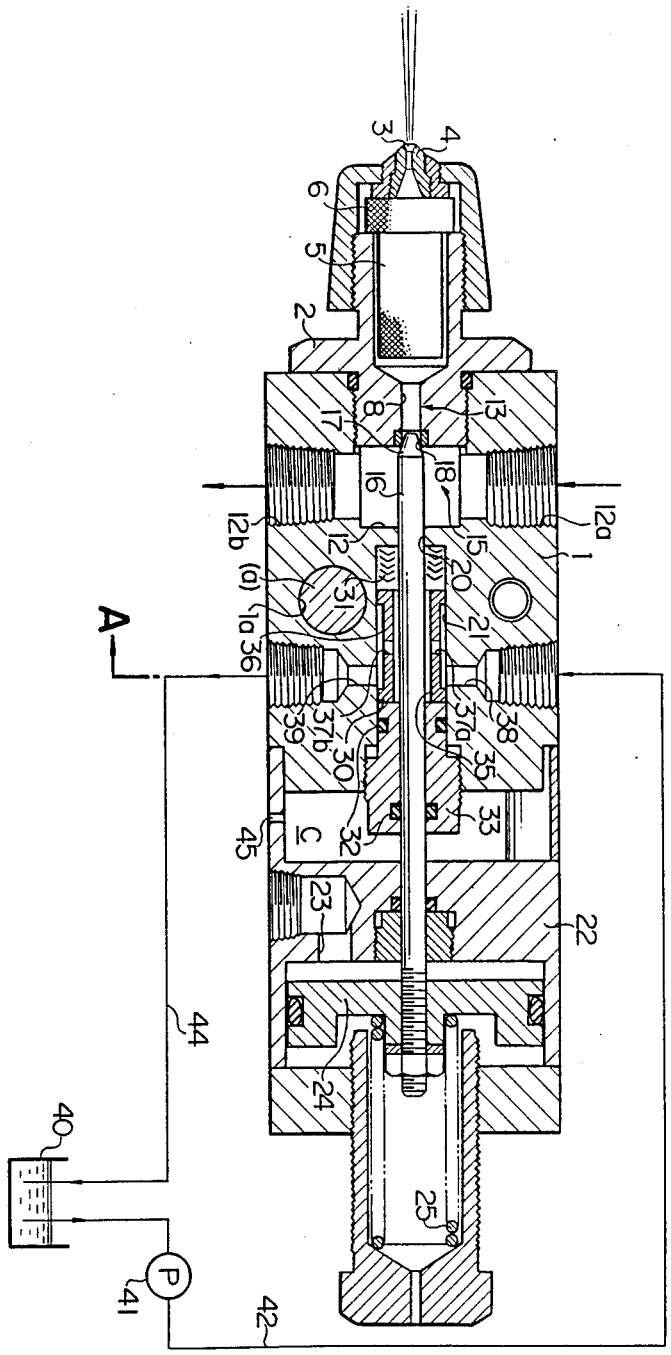
FIG. 1 is a longitudinal sectional view of an embodiment of the spray gun according to the invention.
Figure 2:
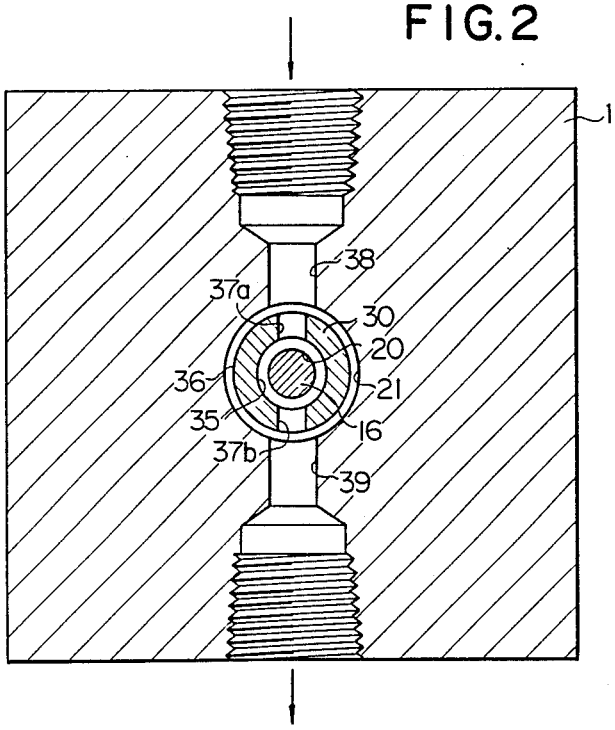
FIG. 2 is an enlarged sectional view taken along the line A—A in FIG. 1.

One embodiment in which the present invention is applied to an airless spray gun for spraying an emulsion paint for non-electrostatic coating will be described with reference to the accompanying drawings.

Referring to the drawings, designated by numeral 1 is a gun body mounted on an automatic coating machine such as a reciprocator or a robot (not shown) by a support pole (a) extending through a mounting hole 1*a*. The gun body 1 has at the forward end portion thereof a feed port 12*a* connected to a paint pressure feeding source (not shown) and a discharge port 12*b* connected to the paint pressure feeding course through a throttle valve (not shown) so that the emulsion paint under high pressure can flow from the feed port 12*a* to the discharge port 12*b*. Fastened to the front end of the gun body 1 is a retainer 2 to which is fixed by a hub nut 6, a nozzle 4 having a paint ejecting opening 3. A filter 5 is provided in a filter chamber in the retainer 2. A center hole 8 is formed in the retainer 2 which communicates with the paint ejecting opening 3 through the filter chamber, and which opens into a paint chamber 12 positioned between the feed port 12*a* and the discharge port 12*b*, whereby a paint feed path 13 is formed for leading the emulsion paint which flows through the feed port 12*a* to the paint ejecting opening 3 through the paint chamber 12, the center hole 8 and the filter 5. An on-off valve 15 for opening and closing the paint feed path 13 is provided at a position where the center hole 8 of the retainer 2 opens into the paint chamber 12. A valve rod 16 has the forward end portion 17 thereof facing into the paint chamber 12 and the valve rod is slidable in a guide hole 20 which extends through the gun body in a manner to communicate the paint chamber 12 and the rear surface of the gun body 1. The forward end portion 17 is a tapered valve body portion and faces and seats against a valve seat 18 to open and close center hole 8.

Along a portion of this guide hole 20 spaced rearwardly from the forward end portion thereof which opens into the paint chamber 12 and in which the valve rod 16 is closely slidably fitted, is an enlarged diameter portion 21 having a diameter larger than that of the valve rod 16. Positioned in this chamber, successively from the forward end, are a V-packing 31 around the rod 16, a tubular member 30 having an inner diameter larger than the outer diameter of the valve rod 16 so as to define a cleaning chamber 35 therearound, and a pressing member 33 having O-rings 32 around the outer and inner peripheries thereof and threadably engaged in the gun body at the rear end portion of the guide hole 20, whereby the V-packing 31 is closely engaged around the outer periphery of the valve rod 16 and the cleaning chamber 35 surrounds the entire outer periphery of the valve rod 16. Around a portion of the outer periphery of tubular member 30 other than the opposite end portions thereof is an annular recess 36 around the entire circumference thereof. A pair of upper and lower communication holes 37a and 37b extend between the annular recess 36 and the cleaning chamber 35. The gun body 1 is provided in the upper portion thereof with a feed port 38 which opens into the annular recess 36 and at the lower portion thereof with a discharge port 39 which opens out of the annular recess 36, and a pressure feeding pump 41 for feeding water under pressure as a solvent for dissolving the emulsion paint is connected to the feed port 38 via a feed hose 42, and a storage tank 40 is connected to the discharge port 39 via a discharge hose 44.

The rear end portion of the valve rod 16 projects from the pressing member 33 to the rear surface of the gun body 1, and is fastened to a piston 24 of an air cylinder 22 fixed to the rear end portion of the gun body 1 at a position spaced from the pressing member 33. When pressurized air is supplied through the port 23 into the air cylinder 22 from a pressurized air source (not shown) by switching of an electromagnetic valve (not shown), the valve rod 16 is retracted by the piston 24 against the resilient force of a compression coil spring 25, whereby the forward end portion 17 of the valve rod 16 is separated from the valve seat 18 to open the valve, so that part of the emulsion paint supplied to the paint chamber 12 is passed through the center hole 8 and ejected through the paint ejecting opening 3. When the pressurized air in the air cylinder 22 is discharged, the valve rod 16 is caused to advance by the resilient force of the compression coil spring 25, whereby the forward end portion 17 of the valve body seats against the valve seat 18 to close the valve, so that ejection of the emulsion paint is stopped. Furthermore, a drain port 45 is formed in the undersurface of a space C formed between the gun body 1 and the air cylinder 22.

In the above-described embodiment, during the coating operation, the water being used as the solvent is fed into the feed port 38 by the operation of the pressure feeding pump 41, and the water thus fed is divided so as to flow along two routes, including a first route in which the water is passed through the annular recess 36 around the tubular member 30 into the upper communication hole **37*a* and flows into the cleaning chamber 35, and thereafter is passed through the lower communication hole 37*b* and reaches the annular recess 36, and a second route in which the water flows along the peripheral surface of the annular recess 36. The two routes join at the bottom portion of the annular recess 36 and the water is discharged through the discharge port 39. During the coating operation, when the emulsion paint in the paint chamber 12 leaks into the gun body 1 along a gap formed between the valve rod 16 and the forward end portion of the guide hole 20, a gap formed between the valve rod 16 and the V-packing 31, the leaking emulsion paint is dissolved in the flowing water and is washed off the outer periphery of the valve rod 16 and is discharged through the discharge port 39**.

Thus, paint itself leaks along the gap formed between the valve rod 16 and the pressing member 33 and leaks out into the space C at the rear surface of the gun body 1, so that, unlike the prior art devices, paint is not solidified on the outer periphery of the valve rod 16, and does not engage the rear face of the pressing member 33 and the front end face of the air cylinder 22. If any paint diluted by the water flows into the space C, the paint and water are discharged through the drain port 45.

In the above-described embodiment, emulsion paint is used as the paint and water as the solvent. However, in place of these, any other paint and solvent suitable for it may be used.

Furthermore, the present invention is applicable to a hand spray gun for ejecting paint by operation of a trigger, is applicable to an electrostatic coating spray gun or an airless spray gun, and is also applicable to a gun for coating a bonding agent.

We claim:

1. The coating gun for discharging a coating material, comprising:

a gun body having a forward end with a discharge nozzle thereon;

a coating material feed path extending through said gun body to said discharge nozzle and having an on-off valve means therein;

a guide hole extending from said feed path to the rear end of said gun body;

a valve rod slidably mounted in said guide hole and closely fitted therein and extending from said valve means to the rear end of said gun body and having a driving mechanism connected thereto at the rear end of said gun body for moving said valve rod for opening and closing said valve means;

said guide hole having a portion along the length thereof with an increased diameter for forming a cleaning chamber around the outer periphery of said valve rod; and said gun body having a solvent feed port opening into said cleaning chamber and a solvent discharge port opening out of said cleaning chamber for leading solvent out of said gun body other than through said guide hole.

* * * * *